US005890662A

United States Patent [19]

Dykstra

[11] Patent Number: 5,890,662

[45] Date of Patent: Apr. 6, 1999

[54] SOLENOID WITH VARIABLE MAGNETIC PATH

[75] Inventor: Daniel R. Dykstra, Wales, Wis.

[73] Assignee: Outboard Marine Corporation, Waukegan, Ill.

[21] Appl. No.: 966,065

[22] Filed: Nov. 10, 1997

[51] Int. Cl.[6] ..... B05B 1/30; H01F 3/12; H01F 7/08

[52] U.S. Cl. ..... 239/585.1; 239/585.4; 239/585.5; 335/126; 335/236; 335/237; 251/129.14; 251/129.18

[58] Field of Search ..... 335/126, 236, 335/237; 239/585.1–585.5; 336/134; 251/129.14, 129.18, 129.15

[56] References Cited

U.S. PATENT DOCUMENTS

| | | | |
|---|---|---|---|
| 220,126 | 11/1879 | Six et al. | 336/134 X |
| 2,438,770 | 3/1948 | Tillman | 336/133 X |
| 2,636,386 | 4/1953 | Schultheis et al. | 336/134 X |
| 5,110,087 | 5/1992 | Studtmann et al. | 251/129.18 X |
| 5,435,343 | 7/1995 | Buezis | 251/129.18 X |
| 5,513,673 | 5/1996 | Slavin et al. | 251/129.18 X |
| 5,608,369 | 3/1997 | Irgens et al. | 335/281 |
| 5,661,895 | 9/1997 | Irgens | 251/129.19 X |

*Primary Examiner*—Joseph A. Kaufman
*Assistant Examiner*—Robin O. Evans
*Attorney, Agent, or Firm*—Jones, Day, Reavis & Pogue

[57] ABSTRACT

An electromagnetic solenoid includes a housing enclosing an electromagnetic coil assembly. An armature is disposed within the electromagnetic coil assembly. An end of the housing is provided with an annular groove. A nut is selectively received by the groove for varying the magnetic path of the coil assembly. Adjustment of the nut thereby sets the solenoid at a predetermined armature activation force accounting for manufacturing tolerances of the solenoid components as well as variations in the electric current supplied to the coil assembly.

6 Claims, 1 Drawing Sheet

SOLENOID WITH VARIABLE MAGNETIC PATH

BACKGROUND OF THE INVENTION

1. Field of the Invention

The present invention relates generally to electromagnetic solenoid construction and, more particularly, to a solenoid with the capability of being easily adjustable to establish a predetermined armature force to account for variations in the solenoid construction due to manufacturing tolerances and supply voltage deviations.

2. Description of the Prior Art

Electromagnetic solenoids are well-known in the prior art for use in a variety of applications. In one form solenoids may be used in pressure surge fuel pumps which may be fitted with high pressure nozzles suitable for direct injection of fuel into a combustion chamber of an internal combustion engine. These pumps typically comprise an electromagnetic coil which serves to activate an armature which in turn may drive a plunger to create a high pressure fuel condition which opens a valve and causes a fuel spray to be discharged through a nozzle. An example of such a combined pump and nozzle assembly is disclosed in U.S. Pat. No. 5,630,401 to Binversie et al. and assigned to the common assignee herein.

It is important in the design and manufacture of an electromagnetic fuel injection pump for an internal combustion engine to construct such a device such that it delivers a precise amount of fuel to the associated combustion chamber so that a proper fuel-to-air ratio is achieved. Too much fuel can not only waste fuel but also cause undesirable emissions from the engine. Too little fuel can cause the engine to run with excessive heat build-up and damage the engine. With an electromagnetic fuel injection pump constructed by mass production techniques natural manufacturing tolerances can cause such pumps to vary in terms of pumping pressure and fuel discharge quantity. In addition, variations in electrical current to the pump can also cause consequent variations in fuel discharge quantity. Accordingly, it is desirable to provide an electromagnetic fuel injection pump which is readily manufacturable by known mass production techniques but is also adjustable such that it can be set to deliver a precise predetermined amount of fuel despite the occurrence of normal manufacturing tolerances. It is further desirable to provide such a pump which is easily adjusted to account for variations in electrical operating current.

SUMMARY OF THE INVENTION

The present invention improves over the prior art by providing an electromagnetic solenoid comprising a housing enclosing an electromagnetic coil assembly. An armature is disposed within the electromagnetic coil assembly. An end of the housing is provided with an annular groove. A nut is selectively received by the groove for varying the magnetic path of the coil assembly. Adjustment of the nut thereby sets the solenoid at a predetermined armature activation force accounting for manufacturing tolerances of the solenoid components as well as variations in the electrical current supplied to the coil assembly.

BRIEF DESCRIPTION OF THE DRAWING

The foregoing and other novel features and advantages of the invention will be better understood upon a reading of the following detailed description taken in conjunction with the accompanying drawing wherein.

BRIEF DESCRIPTION OF THE PREFERRED EMBODIMENT

Figure 1:
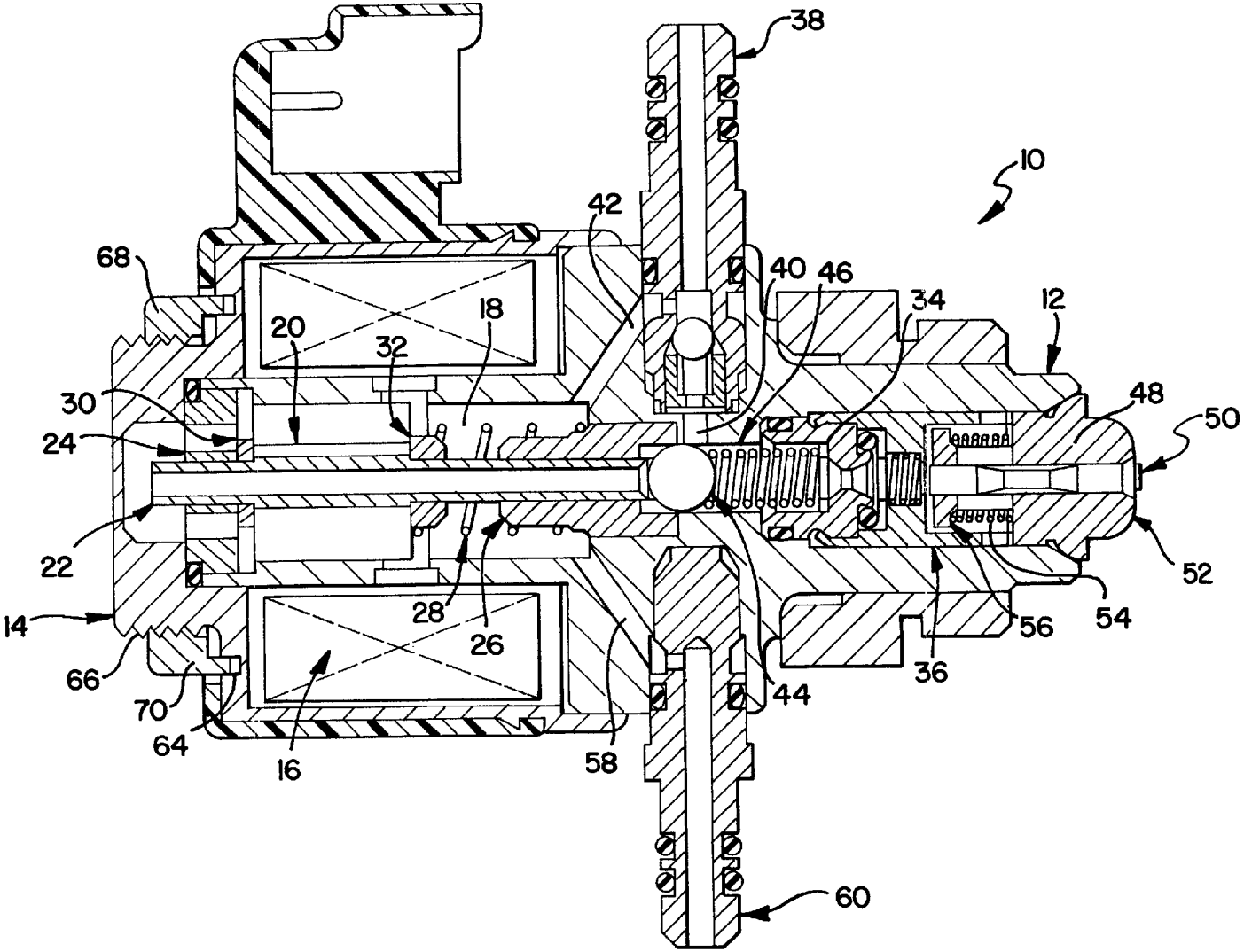
FIG. 1 is a side sectional view of an electromagnetic pressure surge fuel pump employing a solenoid constructed in accordance with the principles of the invention.

Referring now to the drawing, FIG. 1 illustrates an electromagnetic pressure surge fuel pump having a solenoid constructed in accordance with the principles of the invention and designated generally by the reference numeral 10. While the solenoid is illustrated in conjunction with an electromagnetic fuel pump 10, it will be appreciated that the solenoid has numerous other applications not limited to merely fuel pump applications. The pump 10 includes as its principal components a housing assembly comprising a front housing 12 and a rear housing 14. The rear housing encloses an electromangeitc coil assembly 16 and defines a low pressure fuel chamber 18. The coil assembly 16 is generally annular in configuration and is coaxially arranged about an armature 20 disposed in the low pressure fuel chamber 18. The armature 20 is pressed onto a guide tube 22 which is supported by a rear bushing 24 and a front bushing 26 for slidable movement. An armature return spring 28 biases the armature 20 to a rear position within the low pressure fuel chamber 18 against an impact washer 30. A stop 32 is provided to limit the forward movement of the armature 20.

The front housing 12 defines a high pressure fuel chamber 34 provided with an outlet check valve assembly, designated generally by the reference number 36. An inlet nipple and check valve assembly 38 provides for entry of fuel through a passage 40 into the high pressure fuel chamber 34 as well as through a passage 42 into the low pressure chamber 18. A poppet ball 44 is disposed between the high pressure fuel chamber 34 and low pressure fuel chamber 18 and is biased by a poppet spring 46. At the end of the front housing 12 is a nozzle assembly 48 comprising a needle 50 which closes against a nozzle seat 52 biased by a spring 54. The spring 54 is maintained in position by a retainer 56. In the illustrated form of pump 10, fuel enters the lower pressure fuel chamber 18 through the passage 42 and exits the chamber 18 through a passage 58 and outlet nipple 60. This flow of fuel helps cool the rear housing 14 and its internal components.

In accordance with the invention the rear housing 14 of the pump 10 is provided with an annular groove 64 which is formed as to be coaxial with the coil assembly 16 and armature 20. The rear housing 14 is further provided with a male threaded portion 66 which threadedly receives a nut 68. The nut 68 is provided with an annular lip 70 arranged to screw into and out of the groove 64. By this arrangement the nut 68 serves to alter the magnetic path of the coil assembly 16 which, in turn, alters the force exerted by the coil assembly 16 on the movable armature 20. Thus, by adjusting the nut 68 a predetermined amount of force affecting the armature 20 can be manually set, which will consequently determine the amount of fuel pressure in the high pressure fuel chamber 34 and, therefore, the amount of fuel discharged by the nozzle 48 upon electrical activation of the coil assembly 18. It has been found, in practice, that the groove 64 and nut 68 arrangement of the present invention can affect by as much as eight percent (8%) the amount of fuel discharged by the nozzle 48 of the illustrated pump 10. This adjustability has proved to be most adequate to set the fuel discharge of the pump 10 to a desired predetermined quantity despite variations in pump components due to normal manufacturing tolerances as well as normal deviations in electrical current supplied to the coil assembly 18 when the pump 10 is in use.

Although the present invention has been described in connection with a preferred embodiment thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. An electromagnetic pressure surge fuel pump comprising:

a housing assembly defining a low pressure chamber and a high pressure fuel chamber;

an armature disposed within said low pressure fuel chamber;

an electromagnetic coil assembly disposed within said housing assembly, said coil assembly being generally annular in configuration and positioned coaxially of said armature;

a passage through said housing assembly in communication with each fuel chamber for delivering fuel to said fuel chambers;

a valve assembly disposed between said high pressure fuel chamber and said low pressure fuel chamber;

means engaged by said armature for opening said valve assembly and pressurizing said high pressure fuel chamber upon electrical activation of said coil assembly;

an annular groove formed in said housing assembly in coaxial alignment with said armature and coil assembly; and means insertable in said groove for varying a magnetic path created by said coil assembly.

2. The pump of claim 1 including a nozzle assembly disposed in communication with said high pressure fuel chamber at a first end of said housing assembly.

3. The pump of claim 2 wherein said annular groove is formed in a second end of said housing assembly disposed opposite said first end of said housing assembly.

4. The pump of claim 1 wherein said means for varying said magnetic path is a nut.

5. The pump of claim 4 wherein said nut is threadedly secured to said housing assembly.

6. An electromagnetic pressure surge fuel pump of a type for use as a fuel injector of an internal combustion engine comprising:

a housing assembly defining a low pressure fuel chamber and a high pressure fuel chamber;

an armature disposed within said low pressure fuel chamber;

an electromagnetic coil assembly disposed within said housing assembly, said coil assembly being generally annular in configuration and positioned coaxially of said armature;

a passage through said housing assembly in communication with each fuel chamber for delivering fuel to said fuel chambers;

a valve assembly disposed between said high pressure fuel chamber and said low pressure fuel chamber and said low pressure fuel chamber;

a plunger engaged by said armature for opening said valve assembly and pressurizing said high pressure fuel chamber upon electrical activation of said coil assembly;

a nozzle assembly disposed in communication with said high pressure fuel chamber at a first end of said housing assembly;

an annular groove formed in said housing assembly in coaxial alignment with said armature and coil assembly and disposed on a second end of said housing assembly opposite said first end; and a nut threadedly received by said housing assembly and insertable into said annular groove for varying the magnetic path of said coil assembly.

* * * * *